US010003895B2

(12) United States Patent
Fung et al.

(10) Patent No.: US 10,003,895 B2
(45) Date of Patent: Jun. 19, 2018

(54) SELECTIVE ENVIRONMENTAL CLASSIFICATION SYNCHRONIZATION

(71) Applicant: Cochlear Limited, Macquarie University, NSW (AU)

(72) Inventors: Stephen Fung, Dandas Valley (AU); Alexander von Brasch, Cremorne (AU); Michael Goorevich, Naremburn (AU)

(73) Assignee: Cisco Technology, Inc., San Jose, CA (US)

( * ) Notice: Subject to any disclaimer, the term of this patent is extended or adjusted under 35 U.S.C. 154(b) by 128 days.

(21) Appl. No.: 15/164,943

(22) Filed: May 26, 2016

(65) Prior Publication Data

US 2017/0171674 A1 Jun. 15, 2017

Related U.S. Application Data

(60) Provisional application No. 62/265,854, filed on Dec. 10, 2015.

(51) Int. Cl.
*H04R 25/00* (2006.01)

(52) U.S. Cl.
CPC ..... *H04R 25/507* (2013.01); *H04R 2225/41* (2013.01)

(58) Field of Classification Search
CPC ..... H04R 25/558; H04R 2225/41
USPC ..... 381/315
See application file for complete search history.

(56) References Cited

U.S. PATENT DOCUMENTS

| | | | | |
|---|---|---|---|---|
| 9,042,996 | B2 | 5/2015 | Van Baelen et al. | |
| 2004/0042651 | A1* | 3/2004 | Ii | G06K 9/6292 382/159 |
| 2011/0176697 | A1* | 7/2011 | Apfel | H04R 25/305 381/314 |
| 2012/0232616 | A1* | 9/2012 | Van Baelen | A61N 1/36032 607/57 |
| 2014/0177894 | A1* | 6/2014 | Preves | H04R 25/00 381/328 |

* cited by examiner

*Primary Examiner* — Sean H Nguyen

(57) ABSTRACT

Disclosed herein are methods, systems, and devices for selecting a scene classification for the operation of a sensory prosthesis, such as a hearing prosthesis. A system of two or more sensory prostheses can receive respective inputs from the environment of a recipient. A scene classification can then be determined for each sensory prosthesis based on the audio input received by each hearing prosthesis. A confidence value can also be determined for each scene classification. A scene classification can then be selected for each sensory prosthesis, from the determined scene classifications, based on the determined confidence values. Such operation can allow each sensory prosthesis to operate according to a respective selected scene classification that could be the same or that could be different from scene classifications selected for other sensory prostheses of the system.

19 Claims, 6 Drawing Sheets

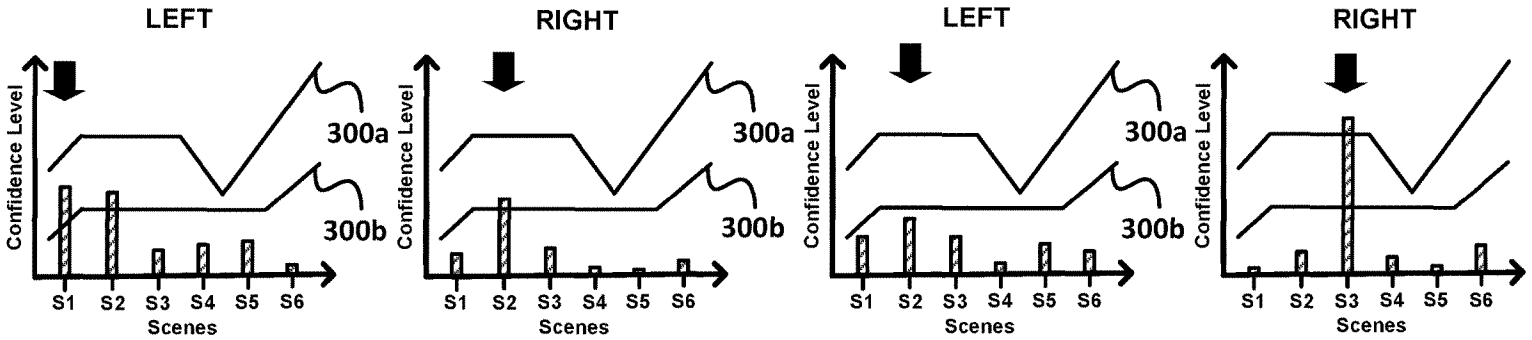
FIG. 3E
FIG. 3F
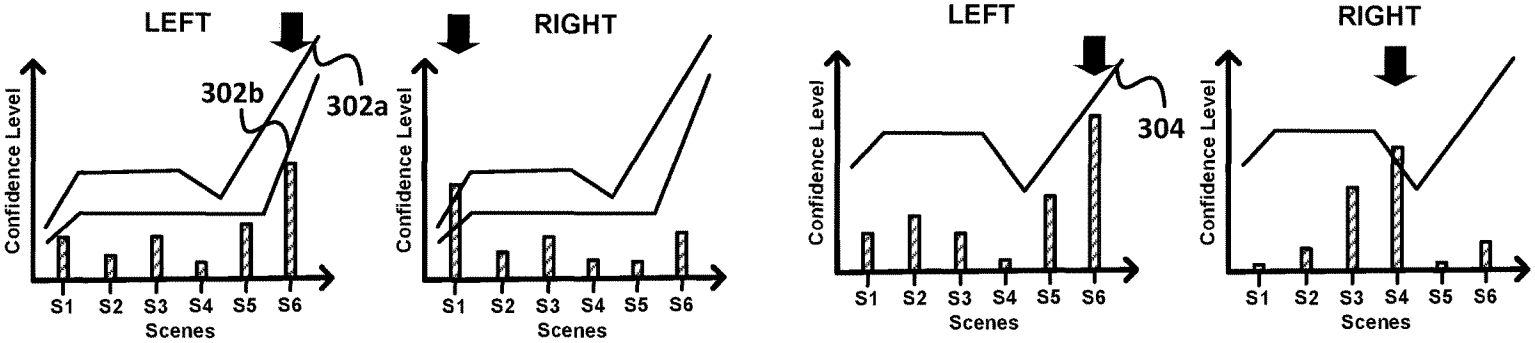
FIG. 3G
FIG. 3H

SELECTIVE ENVIRONMENTAL CLASSIFICATION SYNCHRONIZATION

CROSS-REFERENCE TO RELATED APPLICATION

This application claims priority to U.S. Provisional Patent Application No. 62/265,854, filed Dec. 10, 2015, which is incorporated herein by reference.

BACKGROUND

Unless otherwise indicated herein, the description provided in this section is not itself prior art to the claims and is not admitted to be prior art by inclusion in this section.

Various types of hearing prostheses provide people with different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, or the bones of the middle ear. Sensorineural hearing loss typically results from a dysfunction in the inner ear, including the cochlea where sound vibrations are converted into neural signals, or any other part of the ear, auditory nerve, or brain that may process the neural signals.

People with some forms of conductive hearing loss may benefit from hearing prostheses such as hearing aids or electromechanical hearing devices. A hearing aid, for instance, typically includes at least one small microphone to receive sound, an amplifier to amplify certain portions of the detected sound, and a small speaker to transmit the amplified sounds into the person's ear. An electromechanical hearing device, on the other hand, typically includes at least one small microphone to receive sound and a mechanism that delivers a mechanical force to a bone (e.g., the recipient's skull, or middle-ear bone such as the stapes) or to a prosthetic (e.g., a prosthetic stapes implanted in the recipient's middle ear), thereby causing vibrations in cochlear fluid.

Further, people with certain forms of sensorineural hearing loss may benefit from hearing prostheses such as cochlear implants and/or auditory brainstem implants. Cochlear implants, for example, include at least one microphone to receive sound, a unit to convert the sound to a series of electrical stimulation signals, and an array of electrodes to deliver the stimulation signals to the implant recipient's cochlea so as to help the recipient perceive sound. Auditory brainstem implants use technology similar to cochlear implants, but instead of applying electrical stimulation to a person's cochlea, they apply electrical stimulation directly to a person's brain stem, bypassing the cochlea altogether, still helping the recipient perceive sound.

In addition, some people may benefit from hybrid hearing prostheses, which combine one or more characteristics of the acoustic hearing aids, vibration-based hearing prostheses, cochlear implants, and auditory brainstem implants to enable the person to perceive sound.

A hearing prosthesis could include an external unit that performs at least some processing functions and an internal stimulation unit that at least delivers a stimulus to a body part in an auditory pathway of the recipient. The auditory pathway includes a cochlea, an auditory nerve, a region of the recipient's brain, or any other body part that contributes to the perception of sound. In the case of a totally implantable medical device, the stimulation unit includes both processing and stimulation components, though an external unit could still perform some processing functions when communicatively coupled or connected to the stimulation unit.

A recipient of the hearing prosthesis may wear the external unit of the hearing prosthesis on the recipient's body, typically at a location near one of the recipient's ears. The external unit could be capable of being physically attached to the recipient, or the external unit could be attached to the recipient by magnetically coupling the external unit and the stimulation unit.

A hearing prosthesis could have a variety of settings that control the generation of stimuli provided to a user based on detected sounds. Such settings can include settings of a filter bank used to filter the received audio, a gain applied to the received audio, a mapping between frequency ranges of received audio and stimulation electrodes, or other settings. A hearing prosthesis can include multiple sets of such settings, where each set is associated with a respective audio environment. For example, a first set of settings could be associated with an audio environment that includes speech in noise (e.g., speech from a waiter in a crowded restaurant) and a second set of settings could be associated with an audio environment that includes music (e.g., music produced by a radio). The first set of settings could include filter bank settings specified to help a user understand speech based on stimuli provided by the hearing prosthesis, and the second set of settings could include filter bank settings specified to help a user perceive the tone or other properties of music based on stimuli provided by the hearing prosthesis. The hearing prosthesis could be configured to identify an audio environment, based on detected sound, and to provide stimuli to a user using a set of settings associated with the identified audio environment.

SUMMARY

It can be beneficial for a device to operate based on information about the environment of the device. Such a device could receive input from the environment and use the input to determine some attribute of the environment. The device could then become set to operate based on the determined attribute.

For example, a hearing prosthesis (e.g., a hearing aid, a cochlear implant, a middle-ear device, or a bone conduction device) could receive audio input from an audio environment of a recipient of the hearing prosthesis. The hearing prosthesis could then, based on the received input, determine a scene classification of the audio environment (e.g., 'quiet', 'speech', 'speech in noise', 'music', or other scene classifications for an audio environment of a hearing prosthesis). The hearing prosthesis could then stimulate, using a version of the audio input that is processed based on the determined scene classification, a recipient of the sensory prosthesis. In this example, the environment is the audio environment. In another example, a pacemaker could detect an electrocardiogram, photoplethysmogram, or some other input from the environment of the pacemaker. The pacemaker could then determine a heart rate, a degree of exertion of a recipient of the pacemaker, or some other attribute of the environment of the pacemaker. The pacemaker could then provide electrical stimulus to the heart of the recipient based on the determined attribute (e.g., the pacemaker could provide electrical stimulus to the heart at a rate determined based on a determined degree of exertion of the recipient). In this example, the environment is the recipient's body. In still another embodiment, a functional electrical stimulation device could detect input from a recipient's nervous system. The functional electrical stimulation device could develop confidence measures about classifying what the recipient is trying to do, e.g., to jump up or to simply stand up. In this example, the environment includes the recipient's nervous system. Other examples are possible as well.

A system could include multiple such devices, and different devices of such a system could be exposed to respective different inputs from the environment of the system. It can therefore be beneficial for such multiple devices to operate based on respective, different determined attributes of the environment rather than operating based on a determined attribute in common between the devices. For example, a recipient of right and left hearing prostheses could drive a car such that one of the hearing prostheses is exposed to a windy environment that includes speech (e.g., from a passenger of the car) and such that the other hearing prosthesis is exposed to a relatively less noisy environment that also includes the speech. In such an example, the left and right hearing prostheses could operate independently to determine respective, different scene classifications based on the audio input received by each of the hearing prostheses.

However, it could also be beneficial in other scenarios for such different devices of a system to operate based on a common determined attribute of an environment of the system. Operation of different devices based on respective different determined attributes could result in the devices operating in a manner that is discordant, unpleasant, confusing, or otherwise suboptimal. For example, a recipient of right and left hearing prostheses could listen to a speaker in a slightly noisy auditorium. In such an example, the left hearing prosthesis could determine a 'speech in noise' scene classification, while the right hearing prosthesis could determine, due to slight differences between the audio inputs received by the hearing prostheses, a 'speech' scene classification. In such an example, it could be beneficial for both the left hearing prosthesis and the right hearing prosthesis to operate according to the same scene classification (for example, such that stimuli presented to the recipient by the right and left hearing prostheses has a similar delay, gain, degree or type of distortion, or other properties appropriate for speech input).

In order to allow multiple devices, as described herein, to operate according to respective different environmental attributes or according to a common determined attribute, confidence values could be determined for the environmental attributes determined with respect to each of the multiple devices. The determined confidence values could then be used to determine whether to use a common attribute for the multiple devices or to independently select determined attributes for each of the multiple devices.

By way of example, first and second devices of a system could receive respective first and second inputs, and a first environmental attribute and first confidence value of the determination of the first environmental attribute could be determined based on the first input, and a second environmental attribute and second confidence value of the determination of the second environmental attribute could be determined based on the second input. If both confidence values are high (indicating, e.g., that both scene classifications are likely to correctly describe their respective inputs), the first and second devices could be operated, respectively, based on the first and second environmental attributes. However, if one of the confidence values is high and the other is low, both the first device and the second device could be operated based on the environmental attribute that corresponds to the confidence value that is high.

A particular device of a system as described herein could operate to select an environmental attribute for itself or could receive a selected environmental attribute from another device of the system. For instance, a first device could, based on input received by the first device, determine a first environmental attribute and a first confidence value for the first attribute. Additionally, the first device could receive, from a second device of the system, a second environmental attribute and a second confidence value for the second environmental attribute. The first device could then select, from the first attribute and the second attribute, based on at least one of the first confidence value or the second confidence value, an environmental attribute and could operate based on the selected environmental attribute. Additionally or alternatively, an environmental attribute could be selected for a first device by a second device. The first device could receive the selected environmental attribute from the second device and could then operate based on the received selected environmental attribute.

A particular system as described herein could include two different types of devices. In some such systems, the two devices overlap in terms of what is being classified (e.g., an audio environment) and how it is being classified (e.g., 'quiet', 'speech', etc.). This is possible even if one device is, e.g., a hearing prosthesis and the other device is, e.g., a bionic eye. A hearing prosthesis typically classifies the audio environment by reference to audio input. A bionic eye typically classifies the auditory environment indirectly by analyzing visual input, e.g., by 'seeing' a band playing instruments or people dancing.

Accordingly, in one respect, disclosed herein is a method that includes receiving first data representing input received by a first sensory prosthesis. The first sensory prosthesis is operable to stimulate a physiological system of a recipient in accordance with the received input and the received input represents an environment of the recipient. The received input is then used to determine a first scene classification of the environment of the recipient and to determine a first confidence value of the first scene classification. The method additionally includes receiving, from a second sensory prosthesis, a second scene classification of the environment of the recipient and a second confidence value of the second scene classification. Based on at least the received second confidence value, a scene classification is selected from the first scene classification and the second scene classification. A stimulation signal is then generated by processing the received input based on the selected scene classification. Finally, the first sensory prosthesis stimulates the physiological system of the recipient based on the generated stimulation signal.

In another respect, disclosed herein is a method that includes receiving first data representing first input received by a first sensory prosthesis. The first sensory prosthesis is operable to stimulate a first physiological system of a recipient in accordance with the received first input and the received first input represents an environment of the recipient. The received first input is then used to determine a first scene classification of the environment of the recipient and to determine a first confidence value of the first scene classification. The method additionally includes receiving second data representing second input received by a second sensory prosthesis. The second sensory prosthesis is operable to stimulate a second physiological system of a recipient in accordance with the received second input and the received second input represents the environment of the recipient. The received second input is then used to determine a second scene classification of the environment of the recipient and to determine a second confidence value of the second scene classification. A scene classification is then selected, from the first scene classification and the second scene classification, based on at least one of the first and second confidence values. The first sensory prosthesis then generates a stimulation signal by processing the received input based on the selected scene classification. Finally, the first sensory prosthesis stimulates the first physiological system of the recipient based on the generated stimulation signal.

In addition, in still another respect, disclosed is a system that includes a first device and a second device. The first device is configured to (i) receive a first input representing an environment of the first device, (ii) determine, based on the received first input, a first attribute of the environment of the first device, and (iii) determine a first confidence value of the determination of the first attribute of the environment of the first device. The second device is configured to (i) receive a second input representing an environment of the second device, (ii) determine, based on the received second input, a second attribute of the environment of the second device, and (iii) determine a second confidence value of the determination of the second attribute of the environment of the second device. The first device is additionally configured to (iv) select, based on at least one of the first confidence value and the second confidence value, an attribute from the first attribute and the second attribute. This selection includes, if the first confidence value is high, selecting the first attribute. The selection further could include, if the first confidence value is low and the second confidence value is high, selecting the second confidence value. The first device is still further configured to (v) stimulate a physiological system of a recipient based on the selected attribute.

These as well as other aspects and advantages will become apparent to those of ordinary skill in the art by reading the following detailed description, with reference where appropriate to the accompanying drawings. Further, it is understood that this summary is merely an example and is not intended to limit the scope of the invention as claimed.

BRIEF DESCRIPTION OF THE FIGURES

FIG. 3E illustrates example scene classifications of two hearing prostheses, example confidence values determined for the scene classifications, and the selection of scene classifications by the hearing prostheses, wherein the hearing prostheses select the same scene classification.

FIG. 3F illustrates example scene classifications of two hearing prostheses, example confidence values determined for the scene classifications, and the selection of scene classifications by the hearing prostheses, wherein the hearing prostheses select the same scene classification.

FIG. 3G illustrates example scene classifications of two hearing prostheses, example confidence values determined for the scene classifications, and the selection of scene classifications by the hearing prostheses, wherein the hearing prostheses select the same scene classification.

FIG. 3H illustrates example scene classifications of two hearing prostheses, example confidence values determined for the scene classifications, and the selection of scene classifications by the hearing prostheses, wherein the hearing prostheses select the same scene classification.

DETAILED DESCRIPTION

Figure 1A:
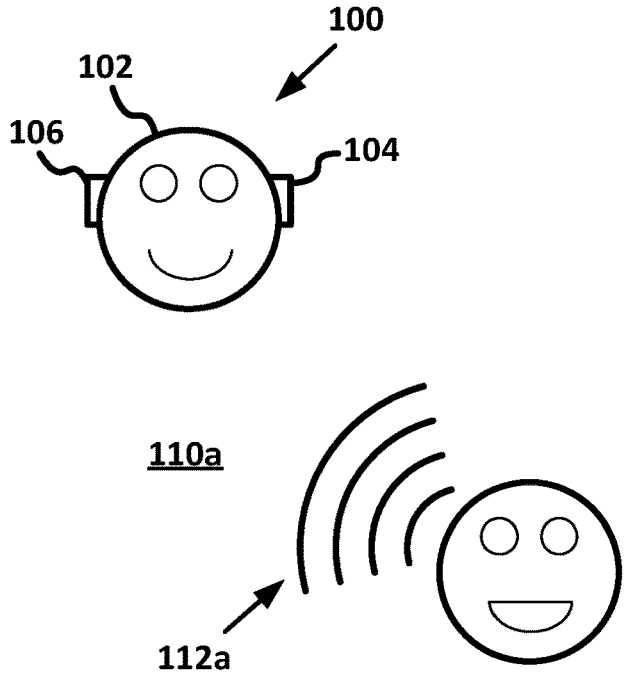
FIG. 1A shows a system receiving audio input from a first example audio environment.

The present disclosure will focus on application in the context of hearing prostheses or hearing prosthesis systems. It will be understood, however, that principles of the disclosure could be applied as well in numerous other contexts, such as with respect to numerous other types of devices or systems that receive input from the environments of such devices or systems. For example, the principles of this disclosure could be applied in the more general context of sensory prostheses and/or sensory prosthesis systems, that is, devices and/or systems that can receive some input from an environment (e.g., an image, a sound, a body motion, or a temperature) and then present a stimulus to a recipient based on the input (e.g., an electrical stimulus to a retina of an eye of the recipient). Further, such systems could include devices that are not sensory prostheses and/or that are not configured to provide stimulus to a recipient. For instance, a system could include a receiver device that receives audio input from the right side of a recipient's head and provides the audio input to another device of the system, e.g., to a hearing prosthesis that receives audio input from the left side of the recipient's head. Further, even within the context of hearing prostheses, it will be understood that numerous variations from the specifics described will be possible. For instance, particular features could be rearranged, re-ordered, added, omitted, duplicated, or otherwise modified.

Hearing prostheses as described herein can operate to receive audio input from an audio environment and to perform operations based on such received audio input. An audio environment at a particular location includes any sounds that are present at the particular location. Such an audio environment could include sounds generated by a variety of sources that are proximate to the particular location or that are sufficiently loud that sound produced by the source is able to propagate to the particular location. Sound sources could include people, animals, machinery or other artificial devices, or other objects. Further, sound sources could include motion or other processes of the air at a particular location. For instance, an audio environment can include wind noise produced at a particular location (e.g., at the location of a microphone) by the motion of air around objects at the particular location. An audio environment could include sounds provided by other sources as well.

A system of multiple hearing prostheses (e.g., a system that includes left and right hearing prostheses of a recipient) could receive, into each of the hearing prostheses, respective audio inputs from an audio environment of the system. Due to differences in the locations, configurations, orientations, or other properties of the multiple hearing prostheses, the audio inputs received by different hearing prostheses could be different. In such examples, it could be advantageous for the multiple hearing prostheses to operate similarly in providing stimuli to a recipient (e.g., to operate using the same filter bank settings) when the received audio inputs are similar according to some characteristic (e.g., when the audio inputs have a similar frequency content). However, it could be beneficial for such hearing prostheses to operate differently (e.g., to operate using different filter bank settings) when the received audio inputs differ according to the characteristic.

Referring to the drawings, FIG. 1A is an illustration of a system 100 that includes first and second hearing prostheses 104, 106 of a recipient 102. The hearing prostheses 104, 106 are configured to receive respective audio inputs from an audio environment 110*a* of the system 100. By way of example, the audio environment 110*a* depicted in FIG. 1A includes speech 112*a* produced by a person near the recipient 102.

The hearing prostheses 104, 106 could, when exposed to the audio environment 110*a* of FIG. 1A, receive similar audio inputs, for instance, audio inputs that both include sounds related to the speech 112*a*, that both have similar noise characteristics, or that are similar in some other way. It could be advantageous for such hearing prostheses 104, 106, when receiving such similar audio inputs, to operate in a similar manner in stimulating the recipient based on their audio inputs.

Figure 1B:
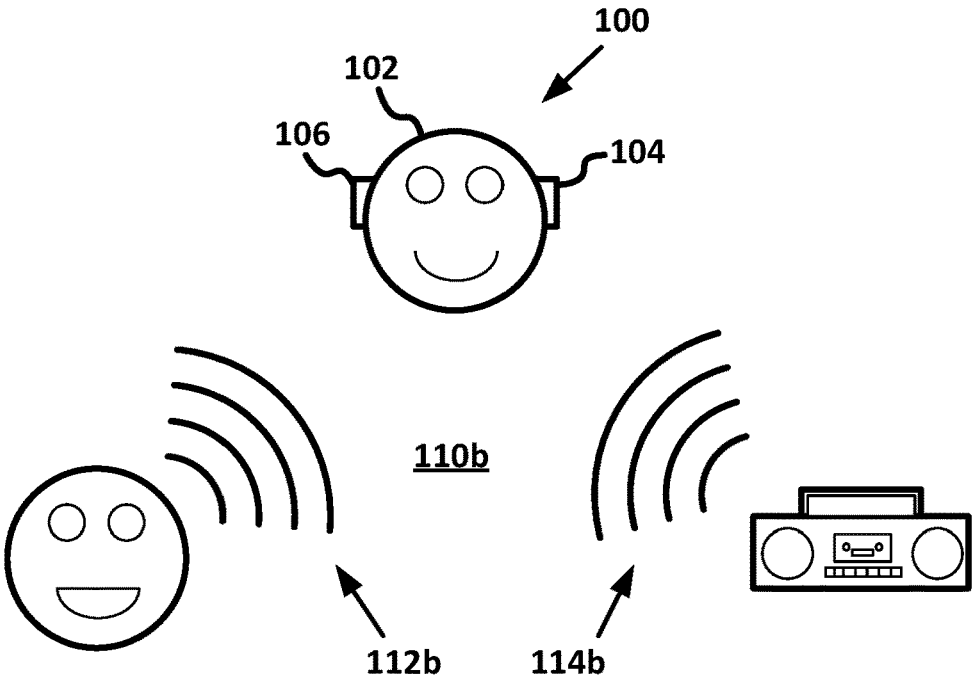
FIG. 1B shows the system of FIG. 1A receiving audio input from a second example audio environment.

When exposed to a different audio environment, however, the hearing prostheses 104, 106 could receive significantly different audio inputs. FIG. 1B is an illustration of the system 100 when the first 104 and second 106 hearing prostheses are receiving respective audio inputs from another example audio environment 110*b*. By way of example, the audio environment 110*b* depicted in FIG. 1B includes speech 112*a* produced by a person to the right of the recipient 102 and music 114*b* produced by a personal stereo to the left of the recipient 102. The hearing prostheses 104, 106 could, when exposed to the audio environment 110*b* of FIG. 1B, receive different audio inputs, for instance, audio inputs that include different amounts of sound related to the speech 112*b* and the music 114*b*. It could be advantageous for such hearing prostheses 104, 106, when receiving such different audio inputs, to operate differently in stimulating the recipient 102 based on their audio inputs.

As noted above, it can be beneficial for a hearing prosthesis to operate based on the characteristics of the audio environment of the hearing prosthesis. This could include the hearing prosthesis (or some other element of a system that includes the hearing prosthesis) determining an attribute of the audio environment and operating based on the determined attribute. The hearing prosthesis operating based on the determined attribute could include the hearing prosthesis using the attribute to set a filter bank parameter, to set a stimulation gain or amplitude, or to set some other operational parameter used by the hearing prosthesis to provide stimuli to a physiological system of a recipient (e.g., to generate electrical stimuli to provide to a cochlea of a recipient). The hearing prosthesis could set such an operational parameter based on a function of the determined attribute (e.g., could set a stimulus intensity based on a logarithmic function of a determined noise amplitude of received audio input) or could set an operational parameter according to a lookup table or other data that describes an association between the operational parameter and a determined attribute. For example, the hearing prosthesis could, in response to determining a particular scene classification, operate according to a set of filter bank parameters that is associated with the particular scene classification.

The hearing prosthesis could determine attributes of an audio environment that are continuous-valued (e.g., a noise level or a frequency content) or that are discrete-valued. A hearing prosthesis could determine such attributes by determining a weighted sum of samples of the audio input, by filtering the audio input, by performing a Fourier transform of the audio input, or by performing some other operations based on the audio input. Further, a hearing prosthesis could determine a discrete attribute of the audio environment by performing operations on one or more such determined continuous valued or discrete valued parameters. For instance, the hearing prosthesis could apply one or more thresholds to the determined parameters, compare a number of determined parameters to a set of templates and determine a most similar template, or perform some other operations to determine a discrete attribute of an audio environment.

In a particular example, a hearing prosthesis could determine a scene classification of an audio environment (e.g., "speech in noise") from a discrete set of possible scene classifications (e.g., a discrete set that includes "speech," "speech in noise," "quiet," "noise," "music," or other classifications). The hearing prosthesis could determine such a scene classification by determining a frequency content audio input received from the audio environment (e.g., by performing a Fourier transform on the audio input, or by applying a number of bandpass filters to the audio input) and comparing the determined frequency content to a set of acoustical templates. The hearing prosthesis could then determine a scene classification that corresponds to the acoustical template, of the set of acoustical templates, that is most similar to the determined frequency content.

Moreover, the hearing prosthesis could determine a number of scene classifications (or other attributes of an audio environment) over time based on received audio input (e.g., based on audio input that is received at different times). The hearing prosthesis could then operate, over time, based on the different determined scene classifications. For instance, the hearing prosthesis could operate, at a particular time, to stimulate a recipient based on a most recently determined scene classification. The hearing prosthesis determining a scene classification at a particular time could include making a determination based on past determined scene classifications.

In a particular example, a hearing prosthesis could determine a plurality of tentative scene classifications based on respective portions of received audio input (e.g., based on respective 32 millisecond windows of the audio input). The hearing prosthesis could then determine a scene classification based on the set of tentative scene classifications. This could include, for example, the hearing prosthesis determining which scene classification of a discrete set of scene classifications occurs the most among the tentative scene classifications or determining which scene classification occurs the most according to a weighted vote among the tentative scene classifications (e.g., a weighted vote that places higher weight on tentative scene classifications are determined based on more recently received audio input).

As noted above, a system that includes multiple hearing prostheses (e.g., left and right hearing prostheses) or other devices (e.g., a cell phone) that receive respective different audio inputs could determine multiple scene classifications (or other environmental attributes) based on the audio inputs. As the audio inputs are different, the determined scene classifications could differ. As noted above, it could be beneficial in some situations for multiple devices (e.g., multiple hearing prostheses) of such a system to operate according to respective different scene classifications (such as the situation illustrated in FIG. 1B) while, in other situations, it could be beneficial for the multiple devices to operate according to a common scene classification (such as the situation illustrated in FIG. 1A). It could also be beneficial for such hearing prostheses to operate according to non-audio inputs that can be used to characterize the audio environment of the hearing prostheses. For example, a camera of a wearable device (e.g., a camera of a head-mounted display) could capture an image of the environment of a wearer and could use the presence of musical instruments in the image to characterize the audio environment of the wearer as including music and/or noise.

Accordingly, a system of hearing prostheses could determine whether to operate multiple hearing prostheses based on a selected single scene classification or to operate the multiple hearing prostheses based on respective scene classifications, which may be different, based on a level of confidence in the determination of each of the scene classifications. In a particular example, left and right hearing prostheses of a system could receive audio inputs. The system could then determine, based on the audio input received by the left hearing prosthesis, a left scene classification and a left confidence value for the left scene classification. The system could also determine, based on the audio input received by the right hearing prosthesis, a right scene classification and a right confidence value for the right scene classification. The system could then, based on the determined confidence values, select whether to operate the left hearing prosthesis based on the left scene classification or based on the right scene classification. The system could perform such a selection for the right hearing prosthesis, as well.

Such a system could determine a confidence value for a determined scene classification (or for some other determined attribute) of an audio environment in a variety of ways. The confidence value could represent the likelihood that a determined scene classification is the correct scene classification, the likelihood that the determined scene classification is the correct scene classification relative to the likelihood that one or more alternative scene classifications is the correct scene classification, a variance or uncertainty of a continuous-valued environmental attribute, or some other measure of a quality of the determination of the scene classification and/or a confidence that the determined scene classification is the correct scene classification of the audio environment. The system could determine the confidence value based on audio input received from the audio environment, e.g., based on the audio input used to determine the scene classification. The system could determine the confidence level based on a property of the audio input, e.g., a variance, a noise level, a noise level variability over time, or some other property of the audio input that can be related to the use of the audio input to determine the scene classification. Additionally or alternatively, the system could determine the confidence level based on some property of the process used to determine the scene classification. Further, a hearing prosthesis could determine the confidence value from either continuous valued or discrete valued parameters.

For instance, the system could determine a plurality of tentative scene classifications, selected from a discrete set of possible scene classifications, based on respective portions of received audio input. The system could then determine a confidence value for each possible scene classification based on the set of tentative scene classifications. This could include, for example, the system determining what fraction of the tentative scene classifications correspond to each of the possible scene classifications. The system could determine such a fraction according to a weighted vote among the tentative scene classifications (e.g., a weighted vote that places higher weight on tentative scene classifications that are determined from more recently received audio input). The system could also determine a scene classification based on the determined confidence values (e.g., could determine the scene classification, from the set of possible scene classifications, that has the highest confidence value).

A system of hearing prostheses could use such determined confidence values in a variety of ways to determine whether to operate multiple hearing prostheses based on a selected single scene classification or to operate the multiple hearing prostheses based on respective different scene classifications. The system could use a decision tree, a lookup table, a genetic algorithm, a hybrid decision tree, or some other method to select, based on the confidence values of determined scene classifications, a scene classification for a hearing prosthesis of the system. The system could compare the confidence values to each other (e.g., the system could determine a difference between the confidence values), could compare the confidence values to one or more thresholds, or could perform some other comparisons using the confidence values and could use the outcome of such comparisons to select a scene classification for a hearing prosthesis of the system. For example, the system could compare a confidence value to one or both of a low threshold level or a high threshold level to determine, respectively, whether the confidence value is 'low' or 'high'.

The system could then use such determinations (e.g., a determination that confidence in a particular scene classification is 'high') to select, from a set of determined scene classifications, a scene classification for a hearing prosthesis. This could include the system determining, for a first hearing prosthesis of the system, a first scene classification based on audio input received by the first hearing prosthesis. The system could operate the first hearing prosthesis based on the first scene classification unless there is a low level of confidence in the first scene classification. If there is a low level of confidence in the first scene classification, the system could select, for the first hearing prosthesis, another determined scene classification that has a high level of confidence (e.g., a scene classification determined based on audio input received by a second hearing prosthesis or by some other element of the system). The system could determine that there is a low level of confidence in the first scene classification by determining that a first confidence value of the first scene classification is lower than a 'low' threshold value, that the first confidence value is lower than some further confidence value (e.g., a second confidence value corresponding to a second scene classification), or that the first confidence value is lower than such a further confidence value by more than a threshold amount.

As noted above, a variety of elements of a system of hearing prostheses could determine scene classifications and/or confidence values, select a scene classification for a hearing prosthesis of the system from a set of determined scene classifications, or perform some other processes as described herein. For instance, a device (e.g., a controller device or a hearing prosthesis) of the system could receive multiple audio inputs (e.g., from multiple hearing prostheses or other devices of the system), determine scene classifications based on such audio inputs, and select a scene classifier from the determined scene classifications for a hearing prosthesis of the system. In another example, first and second hearing prostheses of the system could receive audio inputs and determine, based on their respective received audio inputs, scene classifications and confidence values for the determined scene classifications. The hearing prostheses could then transfer the determined scene classifications and confidence values to each other. Each of the hearing prostheses could then select, from the determined scene classifications, a scene classification for itself based on the determined confidence values.

A system of hearing prostheses could determine and transfer such scene classifications and confidence values on an ongoing basis. For instance, first and second hearing prostheses of the system could determine and transfer scene classifications at a regular rate, e.g., every 32 milliseconds. Alternatively, the system could perform certain of these operations in response to some condition being satisfied. For example, a first hearing prosthesis could determine a first scene classification and a first confidence value for the first scene classification based on audio input received by the first hearing prosthesis. In response to determining that the first confidence value is less than a threshold level, the first hearing prosthesis could transmit a request (e.g., to a second hearing prosthesis or to some other device of the system) for a second scene classification and a second confidence value therefor.

Figure 2A:
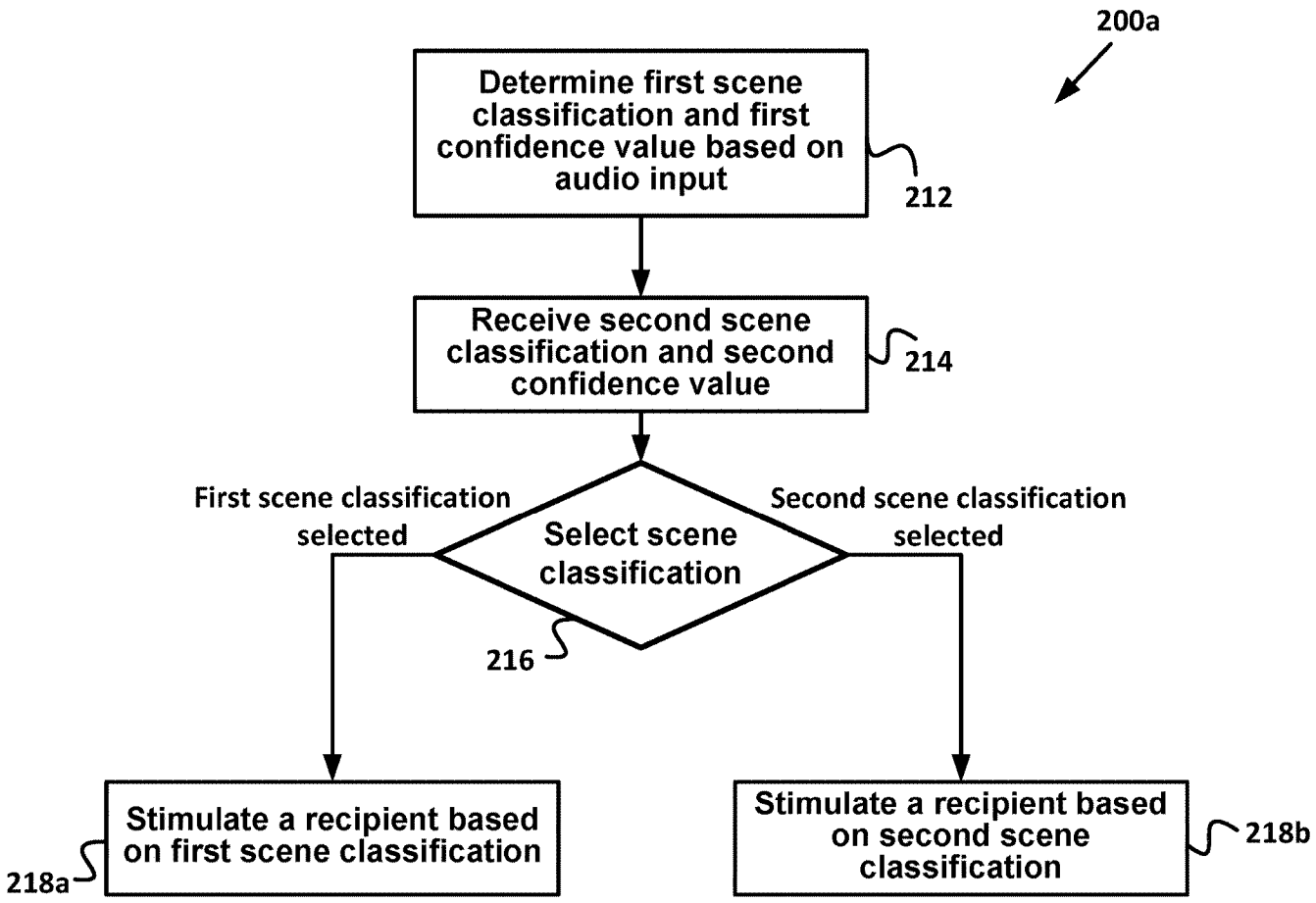
FIG. 2A is a flow chart depicting functions that can be carried out in accordance with the present disclosure.

To illustrate these concepts by way of an example, a flow chart is shown in FIG. 2A depicting functions of a method 200*a* that can be carried out by a system that includes a first hearing prosthesis. The illustrated functions of the method 200*a* could be performed by the first hearing prosthesis, or by some other component of the system.

The method 200*a* begins at block 212 with the system of hearing prostheses determining, based on audio input received by the first hearing prosthesis, a first scene classification and a first confidence value of the first scene classification. A processor of the first hearing prosthesis could make these determinations, or some other processor or device of the system could make these determinations. At block 214, the system receives a second scene classification and a second confidence value of the second scene classification. In practice, the second scene classification and second confidence value can be received by the first hearing prosthesis from another device, e.g., from a second hearing prosthesis or from another device of the system. Such an additional device could determine the second scene classification and the second confidence value based on audio input received by the other device.

Once the system has the first and second scene classifications and the first and second confidence values, at block 216, the system selects one of the first scene classification and the second scene classification based on at least one of the first and second confidence values. This could include applying a threshold to the confidence values, using a decision tree, using a lookup table, using a genetic algorithm, using a hybrid decision tree, or using some other method to select a scene classification. For example, the system could determine whether the first confidence value is high (e.g., is higher than a first threshold, is higher than the second confidence value, is higher than the second confidence value by more than a threshold amount), the first scene classification could be selected. In another example, if the first confidence value is low (e.g., is lower than a first threshold, is lower than the second confidence value, is lower than the second confidence value by more than a threshold amount) and the second confidence value is high, the second scene classification could be selected.

Finally, the first hearing prosthesis stimulates a physiological system of a recipient. This can include, at block 218*a*, providing the stimulation based on the first scene classification if the first scene classification was selected (that is, based on the scene classification determined from the audio input that the first hearing prosthesis received). Alternatively, this can include, at block 218*b*, providing the stimulation based on the second scene classification if the second scene classification was selected. The system could then return to block 212 to select a scene classification again, in order to provide further stimulation to the recipient.

Figure 2B:
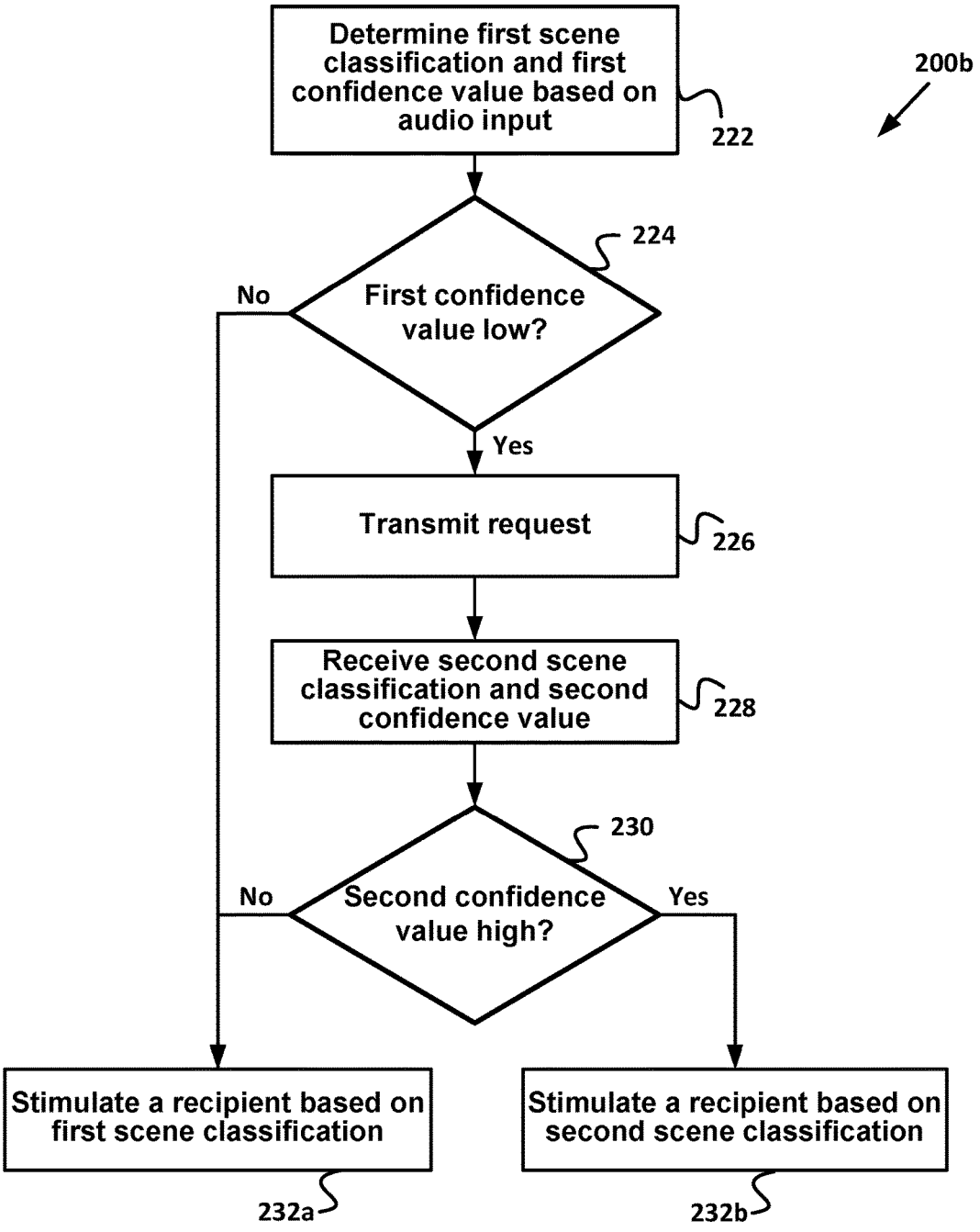
FIG. 2B is a flow chart depicting functions that can be carried out in accordance with the present disclosure.

As noted above, a system of hearing prostheses or a particular hearing prosthesis thereof could determine a scene classification based on received audio input, receive a scene classification (e.g., from a hearing prosthesis), select a scene classification from a set of available scene classifications, or perform some other processes described herein in at a regular rate, in response to a determination that some condition is satisfied (e.g., that a determined confidence value is less than a threshold value), or according to some other consideration. In a particular example, a first hearing prosthesis could request a second scene classification from a second hearing prosthesis when the first hearing prosthesis is not confident in its own estimated scene classification. Such operations are illustrated by way of example in a flow chart shown in FIG. 2B; the flow chart includes functions of a method 200*b* that can be carried out by such a first hearing prosthesis The method 200*b* begins at block 222 with the first hearing prosthesis determining, based on audio input received by the first hearing prosthesis, a first scene classification and a first confidence value of the first scene classification. At block 224, the first hearing prosthesis assesses whether the first confidence value is low. If the first confidence value is not low (e.g., if the first confidence value is not lower than a threshold, is not lower than the second confidence value, is not lower than the second confidence value by more than a threshold amount), the first hearing prosthesis acts, at block 232*a*, to stimulate a physiological system of a recipient (e.g., to electrically stimulate a cochlea of the recipient) based on the first scene classification. Alternatively, the first hearing prosthesis transmits a request, at block 226, to a second hearing prosthesis. This could include the first hearing prosthesis using a radio transmitter to transmit a wireless signal or the first hearing prosthesis transmitting a signal, via a wired tether, to the second hearing prosthesis. At block 228, the first hearing prosthesis receives a second scene classification and a second confidence value of the second scene classification. The second hearing prosthesis could transmit this information in response to the request transmitted at block 226.

After receiving the second scene classification and second confidence value, the first hearing prosthesis assesses, at block 230, whether the second confidence value is high. If the second confidence value is not high (e.g., if the first confidence value is not higher than a threshold, is not higher than the first confidence value, is not higher than the first confidence value by more than a threshold amount), the first hearing prosthesis acts, at block 232*a*, to stimulate the physiological system of the recipient based on the first scene classification. Alternatively, if the second confidence value is high, the first hearing prosthesis acts, at block 232*b*, to stimulate the physiological system of the recipient based on the second scene classification. The first hearing prosthesis could then return to block 222 to select a scene classification again, in order to provide further stimulation to the recipient.

As noted above, a hearing prosthesis could determine, based on audio input received by the hearing prosthesis, a first scene classification and a first confidence value of the first scene classification. The hearing prosthesis could then use the first confidence value to determine whether to use the first scene classification to stimulate a recipient or to use a second scene classification determined by another hearing prosthesis to stimulate the recipient. This could include the hearing prosthesis comparing the first confidence value and/or a second confidence value of the second scene classification to one or more thresholds in order to determine whether the confidence values are low, high, or satisfy some other criterion and to select one of the scene classifications based on such determinations. Such thresholds could depend on the scene classifications (or other determined attributes of an audio environment), e.g., by way of a scene classification dependent threshold function or lookup table. As a result, the hearing prosthesis could apply different threshold values to a confidence value for a "speech" scene classification than are applied to a confidence value for a "speech in noise" scene classification. Such thresholds could be set by a clinician or could be determined according to some other method. Additionally or alternatively, such thresholds could be dynamically updated based, e.g., on audio inputs received by a hearing prosthesis, by user inputs to manually set scene classifications of a hearing prosthesis, or based on some other source of information.

Figure 3A:
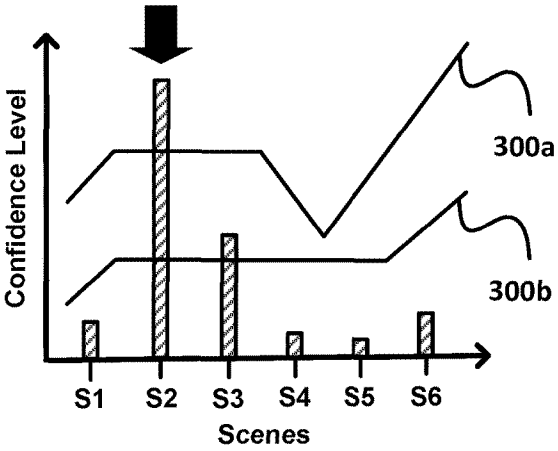
FIG. 3A illustrates example scene classifications of a hearing prosthesis and example confidence values determined for the scene classifications.

As an illustrative example, FIG. 3A shows confidence values (as bars in the figure) that a hearing prosthesis has determined, based on audio input received by the hearing prosthesis, for a discrete number of different possible scene classifications (illustrated as S1 through S6). The hearing prosthesis could determine a scene classification for itself by determining which of the possible scene classifications has the highest confidence value (illustrated by the arrow). The hearing prosthesis could also determine whether the determined confidence value for the determined scene classification, or whether the confidence value for one of the other possible scene classifications, is high, low, or neither based on high and low thresholds for each of the scene classifications. A high threshold function 300*a* illustrates the dependence of determining whether a confidence value is high on the identity of the corresponding possible scene classification. The low threshold function 300*b* illustrates the same for determining whether a confidence value is low. A hearing prosthesis could use such a determination that the confidence value for a determined scene classification is high, low, or neither to select the determined scene classification from a set of determined scene classifications (e.g., from a set that includes the determined scene classification and a further scene classification that is received from a further hearing prosthesis), to request a further scene classification from a further hearing prosthesis, or to perform some other functions.

Figure 3B:
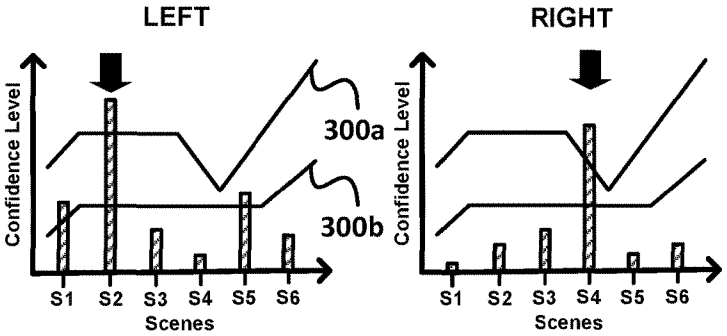
FIG. 3B illustrates example scene classifications of two hearing prostheses, example confidence values determined for the scene classifications, and the selection of scene classifications by the hearing prostheses, wherein the hearing prostheses select different scene classifications.

As noted above, a hearing prosthesis could use such determinations of whether first and second confidence values of respective first and second scene classifications are low and/or high to select one of the scene classifications. This is illustrated by way of example, in FIG. 3B. FIG. 3B shows, similarly to FIG. 3A, confidence values that a left hearing prosthesis has determined for a number of possible scene classifications. The hearing prosthesis has determined a left scene classification (indicated by the left arrow) based on the determined confidence values and has further determined, based on high and low thresholds illustrated by the threshold functions 300*a*, 300*b*, that the confidence value of the left scene classification is high. FIG. 3B also shows confidence values that a right hearing prosthesis has determined, based on audio input received by the right hearing prosthesis, for the possible scene classifications and a right scene classification (indicated by the right arrow) that the right hearing prosthesis has determined. The right hearing prosthesis could send, to the left hearing prosthesis, the determined right scene classification and the confidence value of the right scene classification.

The left hearing prosthesis could then select, based on the confidence values, a scene classification from the left and right scene classifications. This selection could include selecting the left scene classification (that is, the scene classification that was determined based on the audio input received by the left hearing prosthesis) unless there is uncertainty in the left scene classification. For example, if the confidence value for the left scene classification is high and/or if the confidence value for the left scene classification is not low, the left hearing prosthesis could select the left scene classification. This could include, as illustrated in FIG. 3B, the left hearing prosthesis determining that the confidence value of the right scene classification is high, based on a threshold determined for the right scene classification based on the high threshold function 300*a*. Based on the determination that the left scene classification and right scene classification are both high, the left hearing prosthesis could select the left scene classification.

Figure 3C:
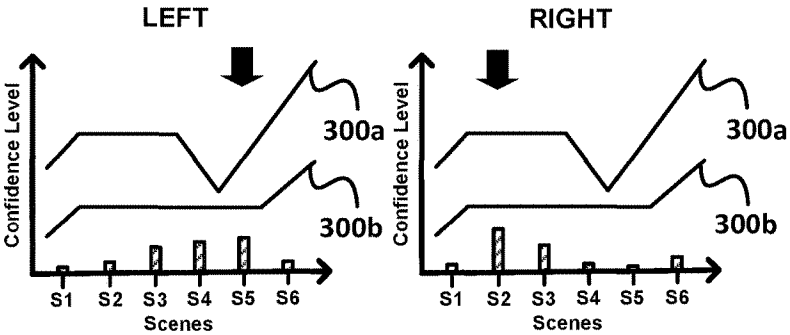
FIG. 3C illustrates example scene classifications of two hearing prostheses, example confidence values determined for the scene classifications, and the selection of scene classifications by the hearing prostheses, wherein the hearing prostheses select different scene classifications.
Figure 3D:
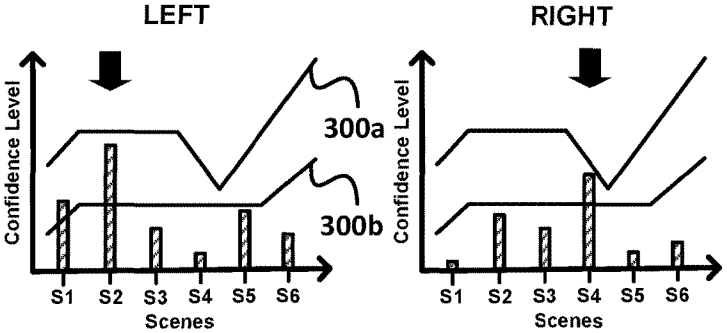
FIG. 3D illustrates example scene classifications of two hearing prostheses, example confidence values determined for the scene classifications, and the selection of scene classifications by the hearing prostheses, wherein the hearing prostheses select different scene classifications.

This selection could also include selecting the left scene classification unless there is a high degree of confidence in the right scene classification. For example, if the confidence value for the left scene classification is low, the left hearing prosthesis could select the left scene classification unless the confidence value for the right scene classification is high. This is illustrated, by way of example, in FIG. 3C, wherein the left hearing prosthesis has determined that the confidence values of both the left and right scene classifications are low. In response to these determinations, the left hearing prosthesis could select the left scene classification. In another example, if the confidence value for the left scene classification is not low, but is also not high, the left hearing prosthesis could select the left scene classification unless the confidence value for the right scene classification is high. This is illustrated, by way of example, in FIG. 3D, wherein the left hearing prosthesis has determined that the confidence values of both the left and right scene classifications are not low and not high (that is, both scene classifications are not lower than the low threshold function 300*b* and not higher than the high threshold function 300*a*). In response to these determinations, the left hearing prosthesis could select the left scene classification.

The left hearing prosthesis selecting a scene classification could include the left hearing prosthesis selecting a scene classification for which the confidence value is not high, but for which the confidence values determined by both the left and right hearing prostheses have some moderate value. This could include determining that the left and right confidence values for a scene classification are both not low. This could further include determining that the left and right hearing prostheses are jointly moderately confident in a scene classification. This could include determining that a sum or other combination of the left and right confidence values is greater than a threshold value. This could additionally or alternatively include, as illustrated in FIG. 3E, the left hearing prosthesis determining that the confidence value of the left scene classification is not high, that the confidence value of the right scene classification is not low and not high, and that the confidence value determined by the left hearing prosthesis for the scene classification corresponding to the right scene classification (i.e., 'S2') is not low and not high. In response to these determinations, the left hearing prosthesis could select the right scene classification.

The left hearing prosthesis selecting a scene classification could include the left hearing prosthesis selecting the right scene classification when there is uncertainty in the left scene classification and certainty in the right classification. In an example, illustrated in FIG. 3F, the left hearing prosthesis could determine that the confidence value of the left scene classification is low and that the confidence value of the right scene classification is high. In response to these determinations, the left hearing prosthesis could select the right scene classification. Such a selection could be performed even in situations wherein the confidence value for the left scene classification is both not high and greater than the confidence value for the right scene classification, if the confidence value for the right scene classification is high. An example of such a scenario is illustrated in FIG. 3G, which illustrates high threshold functions 302*a* and low threshold functions 302*b* and confidence values determined by right and left hearing prostheses for a number of possible scene classifications. As shown in FIG. 3G, the left hearing prosthesis could determine that the confidence value of the left scene classification is low and that the confidence value of the right scene classification is high despite the confidence value of the left scene classification being numerically greater than the confidence value of the right scene classification. In response to these determinations, the left hearing prosthesis could select the right scene classification.

Note that, while the examples illustrated in FIGS. 3A-3G show comparisons of confidence values relative to two thresholds (that is, a high threshold and a low threshold), a hearing prosthesis as described in this disclosure could make other selections of scene classifications, by comparing determined confidence values to fewer or more thresholds or threshold functions, based on other determined confidence values, determined magnitudes (e.g., "high" or "low") of such confidence values, or determined differences between such confidence values. By way of example, FIG. 3H illustrates confidence values that have been determined for a number of possible scene classifications based on input received by a left hearing prostheses and a right hearing prosthesis. A left hearing prosthesis has determined a left scene classification (indicated by the left arrow) based on the determined confidence values and has further determined, based on a single threshold illustrated by the threshold function 304, that the confidence value of the left scene classification is low. The left hearing prosthesis has also determined, based on the threshold function 304, that a right scene classification (indicated by the right arrow) is high. In response to these determinations, the left hearing prosthesis could select the right hearing prosthesis. Some embodiments, such as the embodiment illustrated by FIG. 3H, with a single threshold may be less complex (e.g., as regards implementation in a controller or other device or system) than embodiments that include two or more thresholds but may also be less stable when operating in certain conditions, e.g., conditions wherein a device adopts different classifications more often.

Figure 4:
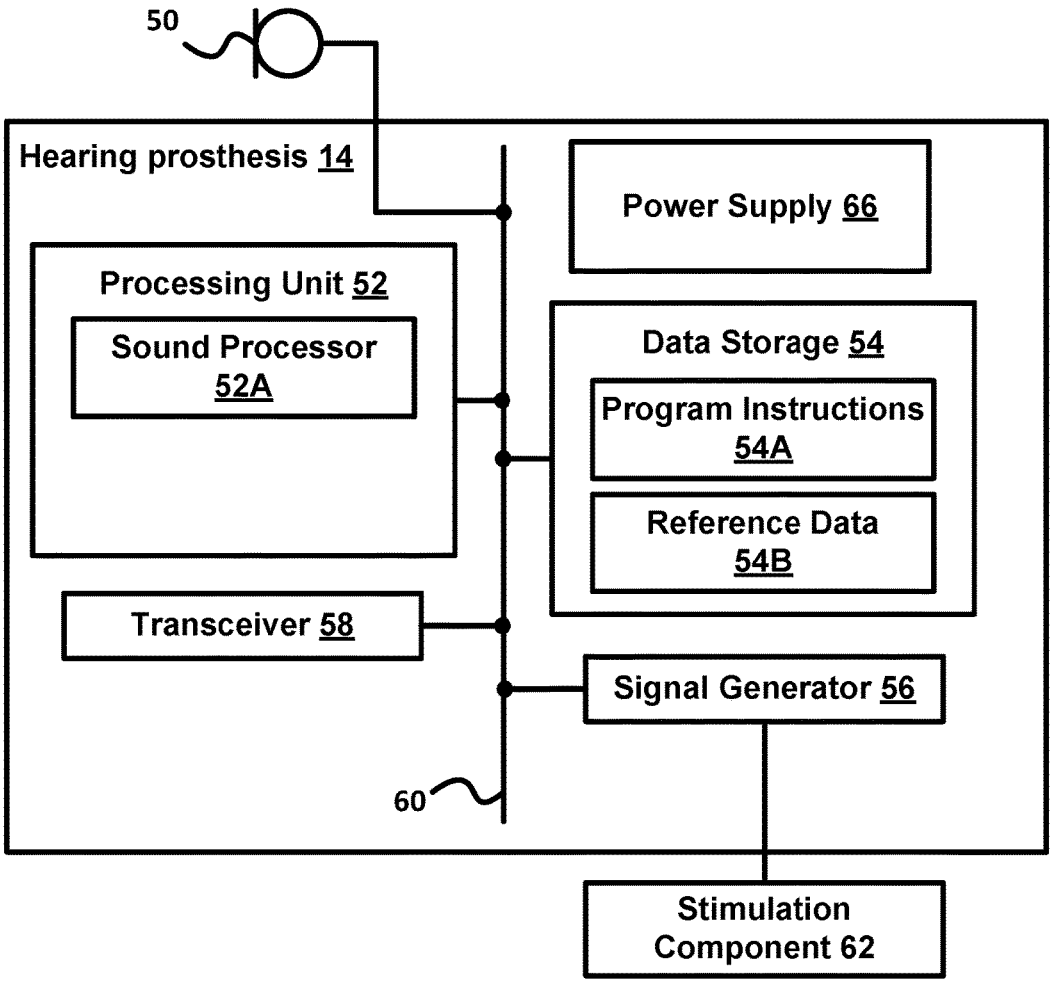
FIG. 4 is a simplified block diagram depicting components of an example hearing prosthesis.

As an illustrative example of a hearing prosthesis that can operate to receive audio input from an audio environment, to provide stimulus to a physiological system of a recipient based on such audio input, to determine a scene classification based on such audio input, or to perform other operations as described in this disclosure, FIG. 4 shows a schematic of a hearing prosthesis 14. The hearing prosthesis 14 includes one or more microphones (or other audio transducers) 50, a processing unit 52, data storage 54, a signal generator 56, and a transceiver 58, which are communicatively linked together by a system bus, network, or other connection mechanism 60. The hearing prosthesis 14 could further include a power supply 66, such as a rechargeable battery, that is configured to provide an alternate power source for the components of the hearing prosthesis 14 when power is not supplied by some external system.

In an example arrangement, each of these components, with the possible exception of the microphone 50, are included in a single housing implanted in the recipient. Alternatively, the power supply 66 could be included in a separate housing implanted in the recipient to facilitate replacement. In a particular arrangement, elements of the hearing prosthesis 14 could be separated into an external unit (that includes, e.g., a battery of the power supply 66, the microphone 50, or some other elements) that is configured to be removably mounted on the outside of a recipient's body (e.g., proximate an ear of the recipient) and an implanted unit (that includes, e.g., the signal generator 56 and the stimulation component 62). The external unit and implanted unit could each include respective transducers, such as inductive coils, to facilitate communications and/or power transfer between the external unit and implanted unit. Other arrangements are possible as well.

In the arrangement as shown, the hearing prosthesis 14 can include a variety of means configured to stimulate a physiological system of the recipient. The stimulation unit 14 can include electromechanical components configured to mechanically stimulate the eardrum, ossicles, cranial bones, or other elements of the recipient's body. Additionally or alternatively, the hearing prosthesis 14 can include electrodes or other means configured to electrically stimulate the cochlea, hair cells, nerves, brainstem, or other elements of the recipient's body.

The processing unit 52 could then comprise one or more digital signal processors (e.g., application-specific integrated circuits, programmable logic devices, etc.), as well as analog-to-digital converters. As shown, at least one such processor functions as a sound processor 52A, to process received sounds so as to enable generation of corresponding stimulation signals to stimulate a recipient, to determine a scene classification based on received audio input, to determine a confidence value for such a scene classification, or to perform some other operations as discussed above.

The data storage 54 could then comprise one or more volatile and/or non-volatile storage components, such as magnetic, optical, or flash storage, and could be integrated in whole or in part with processing unit 52. As shown, the data storage 54 could hold program instructions 54A executable by the processing unit 52 to carry out various hearing prosthesis functions described herein, as well as reference data 54B that the processing unit 52 could reference as a basis to carry out various such functions.

By way of example, the program instructions 54A could be executable by the processing unit 52 to facilitate determining, based on a received audio input, a first scene classification and a first confidence value of the first scene classification, to receive (e.g., via the transceiver 58) a second scene classification and a second confidence value of the second scene classification, and to select a scene classification for the hearing prosthesis 14, from the first and second scene classifications, based on the first and second confidence values. The program instructions 54A could also allow the processing unit 52 to process the audio input using the selected scene classification (e.g., using a set of filter bank coefficients associated with the selected scene classification) in order to generate electrical signals usable by the signal generator 56 and stimulation component 62 to generate one or more stimuli.

The reference data 54B could include settings of adjustable sound-processing parameters, such as a current volume setting, a set of filter bank coefficients, a set of possible scene classifications, or parameters of an algorithm used to determine a scene classification based on received audio input. Moreover, the reference data 54B could include a number of sets of a parameters, each set associated with a respective scene classification, that are usable by the processing unit 52 to process audio input to generate stimuli that can be presented to a recipient, via the signal generator 56 and stimulation component 62, such that the recipient perceives a sound. Note that the listed examples are illustrative in nature and do not represent an exclusive list of possible sound-processing parameters.

The signal generator 56 could include a pulse generator, a controlled-current amplifier, a multiplexer, and other hardware suitable for generating stimuli. Upon receipt of electrical signals from the processing unit 52, the signal generator 56 could responsively cause the stimulation component 62 to deliver one or more stimuli to a body part of the recipient, thereby causing the recipient to perceive at least a portion of a sound. By way of example, the stimulation component 62 could be an electrode array inserted in cochlea of the recipient, in which case the stimuli generated by the signal generator 56 are electrical stimuli. As another example, the stimulation component 62 could be a bone conduction device, and the signal generator 56 could generate electromechanical stimuli. In yet another example, the stimulation component 62 could be a transducer inserted or implanted in the recipient's middle ear, in which case the signal generator 56 generates acoustic or electroacoustic stimuli. Other examples are possible as well.

While various aspects and embodiments have been disclosed herein, other aspects and embodiments will be apparent to those skilled in the art. The various aspects and embodiments disclosed herein are for purposes of illustration and are not intended to be limiting, with the scope being indicated by the following claims.

What is claimed is:

1. A method comprising:

receiving, by a first device, an input, wherein the first device comprises a sensory prosthesis that is operable to stimulate a physiological system of a recipient in accordance with the received input, wherein the received input represents an environment of the recipient;

determining, based on the received input, a first scene classification of the environment of the recipient and a first confidence value of the first scene classification;

receiving, from a second device, a second scene classification of the environment of the recipient and a second confidence value of the second scene classification;

selecting, based on at least the received second confidence value, a selected scene classification from the first scene classification and the second scene classification, wherein the selecting comprises using a hybrid decision tree to select the selected scene classification from the first scene classification and the second scene classification, and wherein the decision tree receives as inputs at least the first confidence value and the second confidence value;

generating a stimulation signal by processing the received input based on the selected scene classification; and stimulating the physiological system of the recipient based on the generated stimulation signal.

2. The method of claim 1, further comprising: determining, at the first device, that the first confidence value is less than a first threshold, in response to determining that the first confidence value is less than the first threshold, sending, to the second device, a request for a second scene classification and the second confidence value; and receiving the second scene classification and the second confidence value only in response to sending the request to the second device.

3. The method of claim 2, further comprising:

determining the first threshold based on at least the first scene classification.

4. The method of claim 2, further comprising:

determining the second threshold based on at least the second scene classification.

5. The method of claim 1, wherein the determining the first scene classification, the receiving the second scene classification, and the selecting are performed a plurality of times to select a plurality of scene classifications over time, and wherein generating the stimulation signal by processing the received input based on the selected scene classification comprises generating the stimulation signal by processing the received input based on a most recently selected scene classification.

6. The method of claim 1, wherein the sensory prosthesis comprises a hearing prosthesis, wherein the received input represents an audio environment of the recipient.

7. The method of claim 6, wherein the sensory prosthesis comprises a cochlear implant, and wherein stimulating the physiological system of the recipient based on the generated stimulation signal comprises providing electrical stimulation to a cochlea of the recipient based on the generated stimulation signal.

8. The method of claim 1, wherein the first threshold and the second threshold are the same.

9. The method of claim 1, further comprising:

determining a plurality of tentative scene classifications, wherein each tentative scene classification is determined based on a respective portion of the received input, wherein the first scene classification of the environment of the recipient and the first confidence value of the first scene classification are determined based on the determined plurality of tentative scene classifications.

10. A method comprising:

receiving, by a first sensory prosthesis, a first input, wherein the first sensory prosthesis is operable to stimulate a first physiological system of a recipient in accordance with the received first input, wherein the received first input represents an environment of the recipient;

receiving, by a second sensory prosthesis, a second input, wherein the second sensory prosthesis is operable to stimulate a second physiological system of a recipient in accordance with the received second input, wherein the received second input represents the environment of the recipient;

determining, at the first sensory prosthesis based on the first input, a first scene classification of the environment of the recipient and a first confidence value of the first scene classification;

determining, at the first sensory prosthesis, that the first confidence value is less than a first threshold;

only in response to determining that the first confidence value is less than the first threshold, sending, to the second sensory prosthesis, a request for a second scene classification and the second confidence value;

in response to the request, receiving a second scene classification of the environment of the recipient determined from the second input and a second confidence value of the second scene classification;

selecting a scene classification from the first scene classification and the second scene classification, wherein the selecting is based on the first confidence value in relation to a first threshold and the second confidence value in relation to a second threshold;

generating, by the first sensory prosthesis based on the selected scene classification, a stimulation signal by processing the received first input; and stimulating, by the first sensory prosthesis, the first physiological system of the recipient based on the generated stimulation signal.

11. The method of claim 10, further comprising:

determining the first threshold at least partially based on the first scene classification.

12. The method of claim 10, further comprising:

determining the second threshold at least partially based on the second scene classification.

13. The method of claim 10, wherein selecting, based on the first confidence value in relation to a first threshold and the second confidence value in relation to a second threshold comprises:

making a determination of whether the second confidence value is greater than the second threshold; and in response to determining that the first confidence value is less than the first threshold and that the second confidence value is greater than the second threshold, selecting the second scene classification, otherwise selecting the first scene classification.

14. The method of claim 10, wherein the first confidence value is greater than the second confidence value.

15. The method of claim 10, wherein the first sensory prosthesis and the second sensory prosthesis are hearing prostheses, wherein the received first input and received second input each represent an audio environment of the recipient.

16. The method of claim 15, wherein the first sensory prosthesis is associated with a first ear of the recipient, wherein the second sensory prosthesis is associated with a second ear of the recipient, and wherein at least one of the first sensory prosthesis or the second sensory prosthesis comprises a cochlear implant.

17. The method of claim 10, wherein the selecting comprises using a hybrid decision tree to select, from the first scene classification and the second scene classification, a scene classification, and wherein the decision tree receives as inputs at least the first confidence value and the second confidence value.

18. The method of claim 10, further comprising:

determining a plurality of tentative scene classifications, wherein each tentative scene classification is determined based on a respective portion of the first input, wherein the first scene classification of the environment of the recipient and the first confidence value of the first scene classification are determined based on the determined plurality of tentative scene classifications.

19. A method comprising:

receiving, by a first sensory prosthesis, a first input, wherein the first sensory prosthesis is operable to stimulate a first physiological system of a recipient in accordance with the received first input, wherein the received first input represents an environment of the recipient;

receiving, by a second sensory prosthesis, a second input, wherein the second sensory prosthesis is operable to stimulate a second physiological system of a recipient in accordance with the received second input, wherein the received second input represents the environment of the recipient;

determining, based on the first input, a first scene classification of the environment of the recipient and a first confidence value of the first scene classification;

determining, based on the second input, a second scene classification of the environment of the recipient and a second confidence value of the second scene classification;

selecting a scene classification from the first scene classification and the second scene classification, wherein the selecting is based on the first confidence value in relation to a first threshold and the second confidence value in relation to a second threshold, wherein the first threshold is at least partially based on the first scene classification and the second threshold is at least partially based on the second scene classification;

generating, by the first sensory prosthesis based on the selected scene classification, a stimulation signal by processing the received first input; and stimulating, by the first sensory prosthesis, the first physiological system of the recipient based on the generated stimulation signal.

* * * * *